US006327744B1

(12) United States Patent
Dorma

(10) Patent No.: US 6,327,744 B1
(45) Date of Patent: Dec. 11, 2001

(54) ROLL-UP DOOR COUNTERBALANCING APPARATUS AND METHOD

(75) Inventor: Edward Dorma, Sarasota, FL (US)

(73) Assignee: Industrial Door Co., Inc., Minneapolis, MN (US)

( * ) Notice: Subject to any disclaimer, the term of this patent is extended or adjusted under 35 U.S.C. 154(b) by 0 days.

(21) Appl. No.: 09/364,721

(22) Filed: Jul. 30, 1999

Related U.S. Application Data

(60) Provisional application No. 60/094,728, filed on Jul. 30, 1998.

(51) Int. Cl.[7] ..... E05F 1/00

(52) U.S. Cl. ..... 16/197; 160/191

(58) Field of Search ..... 16/197, 198, DIG. 1, 16/400; 160/191, 192, 193, 201, 318; 49/200

(56) References Cited

U.S. PATENT DOCUMENTS

| | | | | |
|---|---|---|---|---|
| 748,641 | | 1/1904 | Newell . | |
| 1,641,506 | | 9/1927 | Smurr . | |
| 2,350,286 | | 5/1944 | Michelman | 160/313 |
| 3,635,277 | | 1/1972 | Bahnsen | 160/191 |
| 3,685,567 | | 8/1972 | Pemberton et al. | 160/8 |
| 3,921,761 | | 11/1975 | Votroubek et al. | 185/39 |
| 3,979,977 | | 9/1976 | Dorma | 81/57.13 |
| 4,523,620 | | 6/1985 | Mortellite | 160/315 |
| 4,681,279 | | 7/1987 | Nakamura | 242/107.3 |
| 4,817,927 | * | 4/1989 | Martin | 160/191 |
| 4,882,806 | | 11/1989 | Davis | 16/198 |
| 4,930,182 | * | 6/1990 | Eichenberger | 16/197 |
| 4,981,806 | | 1/1991 | Miller et al. | 160/191 |
| 5,078,198 | | 1/1992 | Tedeschi | 160/315 |
| 5,239,777 | | 8/1993 | Husselton | 49/200 |
| 5,419,010 | | 5/1995 | Mullet | 16/198 |
| 5,522,446 | | 6/1996 | Mullet et al. | 160/229.1 |
| 5,568,672 | | 10/1996 | Mullet et al. | 16/94 R |
| 5,577,544 | | 11/1996 | Carper et al. | 160/191 |
| 5,615,723 | | 4/1997 | Carper | 160/191 |
| 5,632,063 | | 5/1997 | Carper et al. | 16/198 |
| 5,636,678 | | 6/1997 | Carper et al. | 160/191 |
| 5,865,235 | * | 2/1999 | Krupke et al. | 160/191 |
| 5,964,268 | * | 10/1999 | Carper et al. | 16/198 |
| 5,964,426 | | 10/1999 | Tabellini | 242/372 |
| 6,089,306 | | 7/2000 | Frey, Jr. | 160/302 |

FOREIGN PATENT DOCUMENTS 43 41 309 C 1 3/1995 (DE) .

OTHER PUBLICATIONS

EZ—Set Torsion Spring System information, © 1997 Clopay Building Products Co., A Griffon Company.
EZ—Set Torsion Spring System information, © 1998 Clopay Building Products Inc., A Griffon Company.

* cited by examiner

*Primary Examiner*—Chuck Y. Mah
(74) *Attorney, Agent, or Firm*—Kinney & Lange, P.A.

(57) ABSTRACT

The disclosure sets forth an apparatus and method for counterbalancing a roll-up door. A first threaded shaft is concentrically disposed around a torsion shaft and a spring is also disposed around the torsion shaft. The spring has a first end and a second end. The first end of the spring is secured to a first anchor plate that is threadably mounted to thread onto the threaded shaft. The second end of the spring is fixed relative to the torsion shaft. When the threaded shaft is rotated, the first anchor plate moves along the threaded shaft, thereby longitudinally stretching the spring a predetermined distance. A first stop prevents the movement of the first anchor plate along the threaded shaft beyond a predetermined position so that further rotation of the threaded shaft winds the spring thereby applying a predetermined counterbalancing torque on the torsion shaft.

15 Claims, 7 Drawing Sheets

ROLL-UP DOOR COUNTERBALANCING APPARATUS AND METHOD

CROSS-REFERENCE TO RELATED APPLICATION(S)

This application claims priority from U.S. Provisional Patent Application Ser. No. 60/094,728 filed on Jul. 30, 1998, for "Counterbalancing Apparatus for Roll-up Door" by Edward Dorma.

BACKGROUND OF THE INVENTION

The present invention relates to torsion spring counterbalancing mechanisms for compensating the weight of roll-up doors. More particularly, the present invention relates to a faster, safer, and easier apparatus and method for loading the coil torsion spring of roll-up doors.

Roll-up doors, commonly referred to as overhead garage doors, typically use counterbalancing mechanisms incorporating coil springs placed under a rotational or torsion force to apply a lifting force to the door. The springs are concentrically positioned about a shaft rotatably mounted on fixed supports. The shaft carries hubs accommodating cables. The cables are attached to the door so that when the hubs are rotated, a lifting force will be applied to the door. The lifting force is transmitted to the hubs via the shaft by the torsion springs.

Conventional torsion springs used in door counterbalancing mechanisms have adjacent coils that engage or abut one another when the spring is in its normal unwound resting state. There is no gap between adjacent coils. During the winding process of a torsion coil spring, friction forces are generated between adjacent coils of the spring.

Conventional coil torsion springs having abutting coils do not provide for growth and contraction of the spring during the initial winding of the spring unless one end remains unfixed, nor do such springs provide for the springs unwinding aid winding after installation of the roll-up door. Carper et al. U.S. Pat. No. 5,632,063 discloses a sliding cone to anchor an end of the torsion spring to the shaft to allow the spring to elongate and contract as the roll-up door opens and closes. This requires a modification of the end cone and rod as the cone must axially move on the rod. Conventional shafts and end cones for the torsion coil spring cannot be used in the Carper et al. door counterbalancing system.

Generally, a coil torsion spring must be twisted to load the spring or place the spring under torsion force. Heretofore, winding bars or steel rods have been used to turn the cone fitting attached to the spring to load the spring. A limited amount of force can be applied to the spring since twisting the collar is a manual operation. The procedure requires a considerable amount of time and can be dangerous as the spring is loaded with considerable force. Worm gear power transmission units have been incorporated in door counterbalancing mechanisms. Examples of this type of power transmission unit to wind or twist torsion springs are disclosed by Votroubek et al. U.S. Pat. No. 3,921,761 (which is incorporated herein by reference). Votroubek et al. recognizes the danger involved in winding and unwinding a garage door torsion spring and attempts to address this problem. Votroubek et al. utilizes a tool with a self-locking worm drive gear and worm wheel which can be put into place about the torsion shaft to effect a gripping of an end collar for connecting the spring to the torsion shaft. After the collar is gripped, the end collar is released from the shaft for movement along the rotation about the torsion shaft. In Votroubek et al., the tool is mounted on the torsion shaft and blocked against rotation about the torsion shaft in a manner to allow the tool to move axially on the torsion shaft, as the spring is wound, to accommodate the growth of the spring during winding. In a double spring configuration using the Votroubek et al. tool, the springs would be wound and unwound separately with the tool being used to wind the outer-end of each spring.

While the Votroubek et al. tool lessens danger, as compared to the conventional use of a lever bar for winding or unwinding a spring, the spring end is still held by a tool which is separate from the hardware of the counterbalancing mechanism and which must be assembled and disassembled to the counterbalancing mechanism for each winding, unwinding or adjustment of a torsion spring. This tool also must be securely blocked against rotation as a whole about the axis of the torsion rod each time a spring end is to be wound or unwound. Further, during the use of the tool, as in the case of using a lever bar, the door being counterbalanced is placed in a locked position until the winding operation has been completed and the freed end cones or members of the spring are resecured to the torsion shaft. With the door locked, the setting of the proper spring forces in the torsion spring or springs is done with the use of charts and spring characteristic specifications. When working in this manner, it is more difficult to adjust to the proper counterbalancing forces, as is true of all the present conventional methods known to applicant, for setting the torsion in a torsion counterbalancing mechanism for a garage door.

Mullet U.S. Pat. No. 5,419,010 (which is incorporated herein by reference) discloses a counterbalancing mechanism for sectional doors that features a duel shaft system. The counterbalancing mechanism of Mullet has a drive tube 30 extending between a pair of drums and being non-rotatably affixed thereto, a coil spring 80 positioned interiorly of the drive tube, the coil spring having one end 82 non-rotatably affixed to the drive tube and the other end 81 non-rotatably affixed to the shaft, and a tension adjusting mechanism. The counterbalancing system disclosed in Mullet is more complicated to install and maintain because the duel shaft system uses non-standard components, thereby creating complicated maintenance and repairs to the torsion spring assembly.

Carper et al. U.S. Pat. No. 5,632,063 and Carper et al. U.S. Pat. No. 5,636,678 (which are incorporated herein by reference) disclose an overhead door apparatus utilizing a torsion spring counterbalancing mechanism. The counterbalancing mechanism includes a worm drive ring-shaped gear winding mechanism for setting the appropriate torque or number of winds in the spring. The torsion spring disclosed in the Carper et al. patents has gaps between adjacent coils making it a non-standard torsion spring and spring assembly. Additionally, the torsion spring counterbalancing mechanism of the Carper et al. patents require specialty anchor and winding cones and specialty drums which are not off-the-shelf components. Thus, the need exists for a counterbalancing mechanism which permits simpler installation and maintenance and uses standard off-the-shelf components.

The present invention eliminates the dangers of prior art mechanisms relating to torsion spring counterbalancing, simplifies the installation and maintenance with an accompanying savings in time and labor, improves the counterbalancing system performance, and utilizes off-the-shelf drums and cones.

BRIEF SUMMARY OF THE INVENTION

The invention, in one form, is an apparatus for counterbalancing a roll-up door. A first threaded shaft is concentrically disposed around a torsion shaft and a spring is also disposed around the torsion shaft. The spring has a first end and a second end. The first end of the spring is secured to a first anchor plate that is threadably mounted to thread onto the threaded shaft. The second end of the spring, via a winding cone, is fixed relative to the torsion shaft. When the threaded shaft is rotated, the first anchor plate moves along the threaded shaft, thereby longitudinally stretching the spring a predetermined distance. A stop prevents the movement of the first anchorplate along the threaded shaft beyond a predetermined position so that further rotation of the threaded shaft winds the spring thereby applying a predetermined counterbalancing torque on the torsion shaft. In a preferred embodiment, the transmission includes a gear positioned generally concentrically around the torsion shaft, and a worm gear that meshes with the gear and is coupled to a drive head allowing a power tool to turn the worm gear.

In another form, the invention resides in a method for counterbalancing a roll-up door. The method includes securing a first end of a spring to a threadably mounted first anchor plate and securing a second end of the spring, via a winding cone, to a torsion shaft. The first threadably mounted anchor plate is then threaded onto a threaded shaft positioned concentrically around the torsion shaft and the threaded shaft coupled to a transmission. The transmission rotates the threaded shaft to cause the first anchor plate to move along the torsion shaft and away from the first end of the spring, thereby longitudinally stretching the spring a predetermined distance and winding the first end of the spring by rotating the first anchor plate thereby applying a predetermined counterbalancing torque on the torsion shaft.

BRIEF DESCRIPTION OF THE DRAWINGS

The present invention will be further explained with reference to the attached figures, wherein like structures are referred to by like numerals throughout the several views.

While the above-identified drawings features sets forth a preferred embodiment, other embodiments of the present invention are also contemplated, as noted in the discussion. This disclosure presents illustrative embodiments of the present invention by way of representation and not limitation. Numerous other modifications and embodiments can be devised by those skilled in the art which fall within the scope and spirit of the principles of this invention.

DETAILED DESCRIPTION

Figure 1:
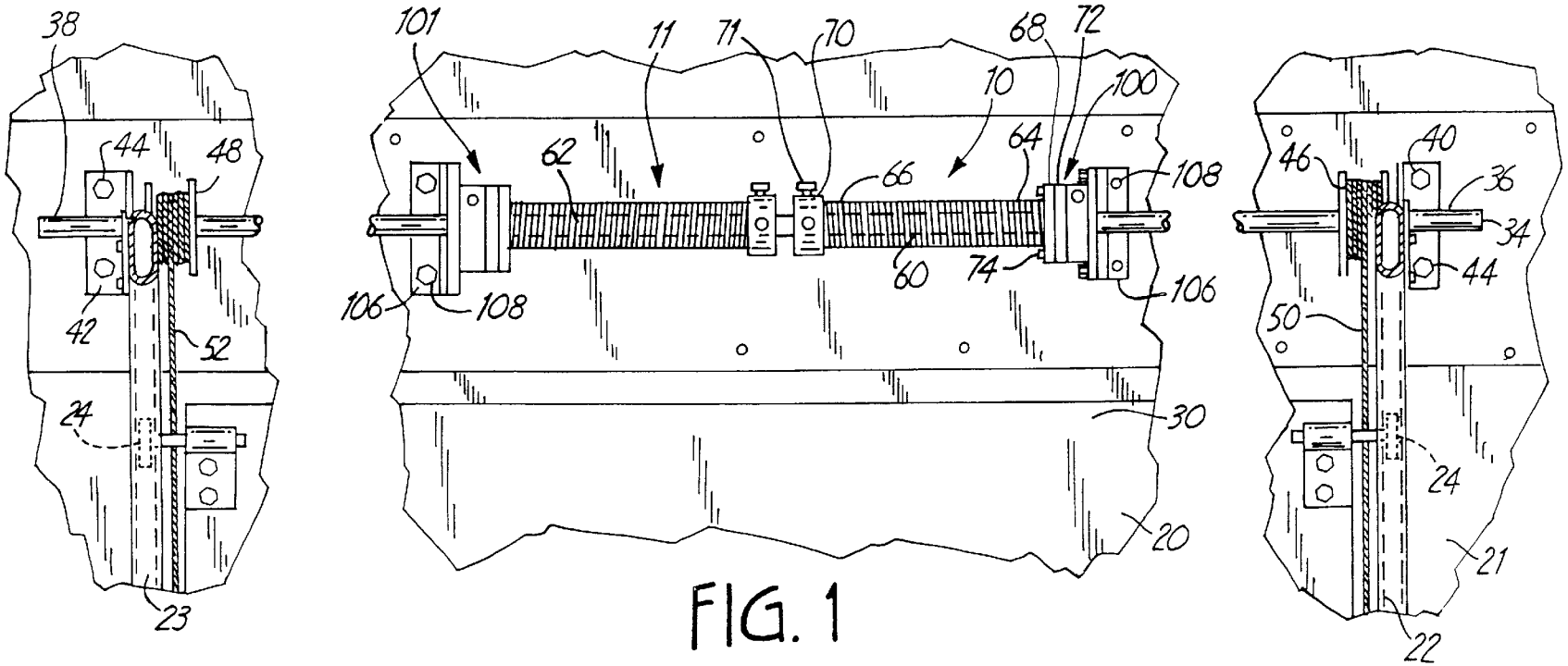
FIG. 1 is a fragmentary elevational view of a roll-up door equipped with a counterbalancing mechanism of the present invention.

A faster, easier, and safer counterbalancing mechanism for a roll-up door of the present invention is shown generally at 10 in FIG. 1. A roll-up door 20 is typically used to provide large openings for a structure 21, such as a garage, warehouse or similar structure. The counterbalancing mechanism 10 permits the opening and slow closing of the roll-up door 20.

Conventional tracks 22 and 23 having upright sections and generally horizontal sections that are secured to the structure 21 to movably support the rollup door 20. A plurality of rollers 24, connected to separate portions of the roll-up door 20, support the roll-up door 20 on the tracks 22 and 23. The roll-up door 20 is typically composed of metal, plastic or wood panels and has considerable weight. The counterbalancing mechanism 10 provides the force necessary to lift the roll-up door 20 open and to slowly close the roll-up door 20. When the roll-up door 20 weighs a significant amount, a pair of counterbalancing mechanisms 10 and 11 may be necessary to support the weight of the roll-up door 20. The following description is directed to the counterbalancing mechanism 10, but is equally applicable to the counterbalancing mechanism 11.

When the roll-up door is in the closed position (FIG. 1), the counterbalancing mechanism 10 is located above a top end 30 of the roll-up door 20 and has a generally transverse torsion shaft 34 having a first end 36 and a second end 38 which are rotatably supported on anchor plates 40 and 42. A plurality of fasteners 44 secure the support blocks 40 and 42 to the structure 21 adjacent the top end 30 of the closed roll-up door 20. In some installations, the torsion shaft 34 is rotatably supported on the remote ends of the tracks 22 and 23. A first drum 46 carrying a first cable 50 is secured to the first end portion 36 of the torsion shaft 34. The lower end of first cable 50 is connected with a suitable fastener (not shown) to a bottom end 32 of the roll-up door 20. In a similar manner, a second drum 48 is fixed to the second end portion 38 of the torsion shaft 34. A second cable 52 wrapped around the second drum 48 extends downwardly and is attached to the bottom end 32 of the roll-up door 20. The counterbalancing mechanism 10 operates to apply torque to the torsion shaft 34 connected to the drums 46 and 48 and the cables 50 and 52 to counterbalance to the bottom 32 of the roll-up door 20.

Figure 2:
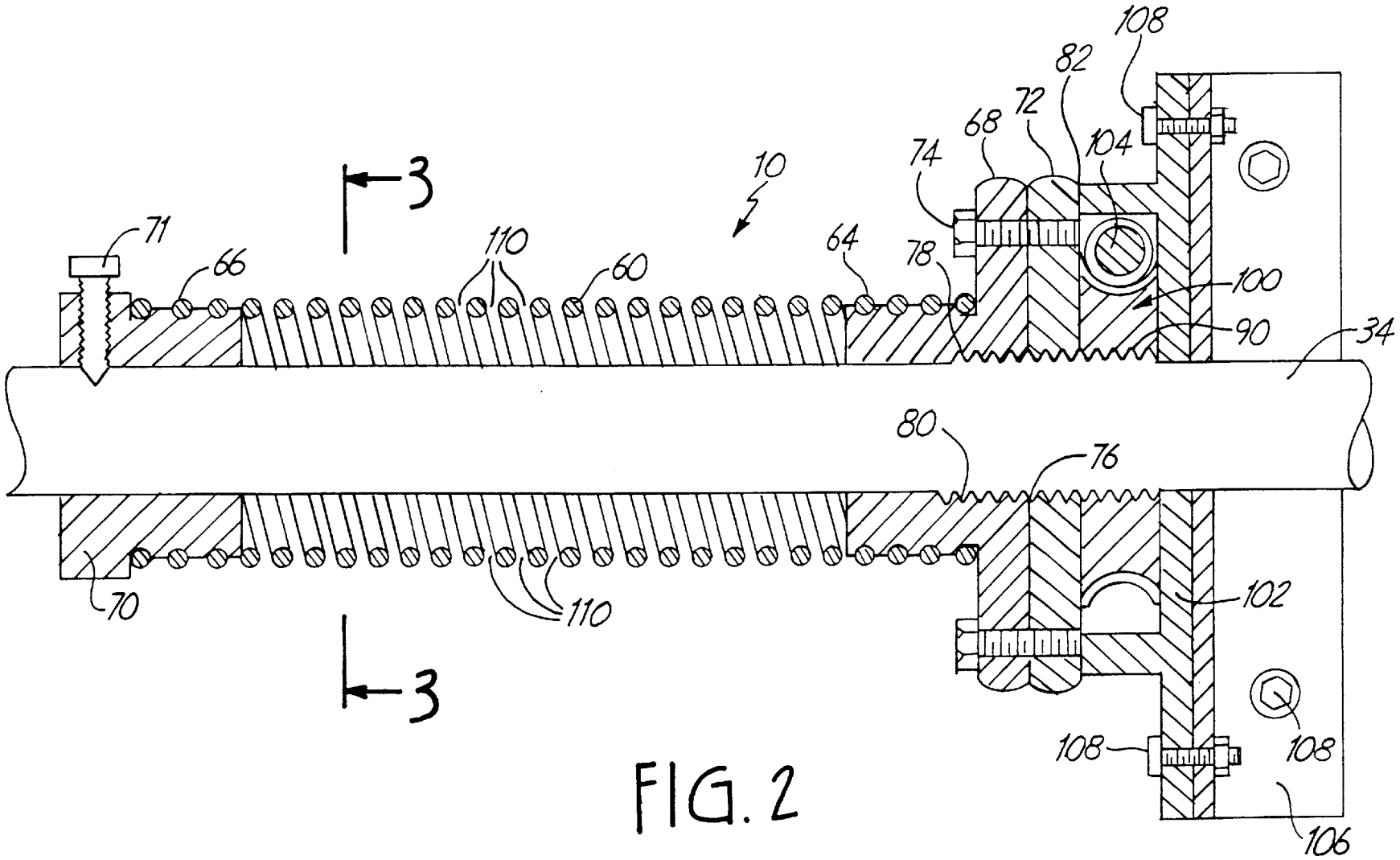
FIG. 2 is an enlarged vertical sectional view of a counterbalancing mechanism of the present invention showing the torsion spring and worm gear unit for applying torque to the torsion spring.
Figure 4:
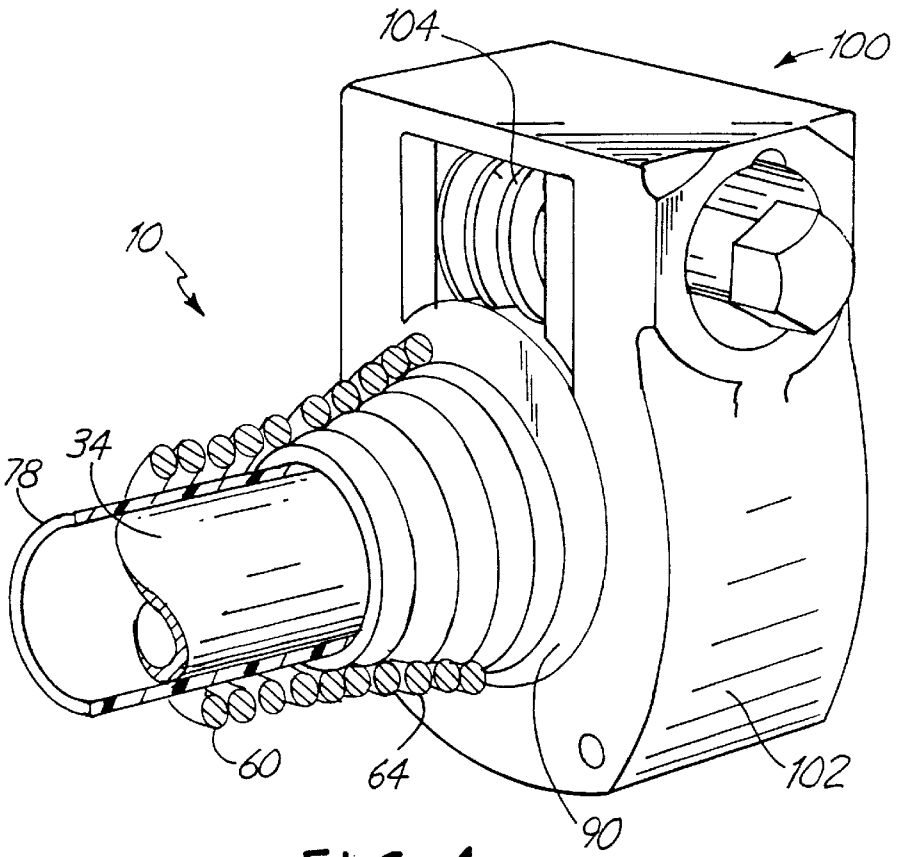
FIG. 4 is a perspective view of a counterbalancing mechanism of the present invention including a power transmission for twisting the torsion spring.
Figure 3:
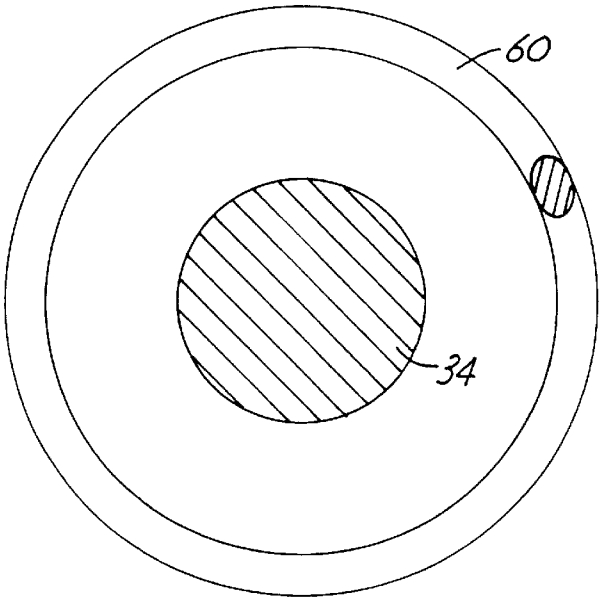
FIG. 3 is an enlarged sectional view as taken along lines 3—3 of FIG. 2.

As best shown in FIG. 2, the torsion shaft 34 is subject to rotational or turning forces by a pair of coils or helical torsion springs 60 and 62. The spring 60 of the counterbalancing mechanism 10 has a first end 64 that is threaded onto a first anchor plate 68. The spring 60 also has a second end 66 that is secured to a second winding cone 70 which fixes the second end 66 of the spring 60 to the torsion shaft 34. The second winding cone 70 is secured to the torsion shaft 34 with one or more set screws 71 and is threaded onto the second end 66 of the spring 60. The spring 60 and the end cones 68 and 70 are conventional structures known in the art.

Figure 5:
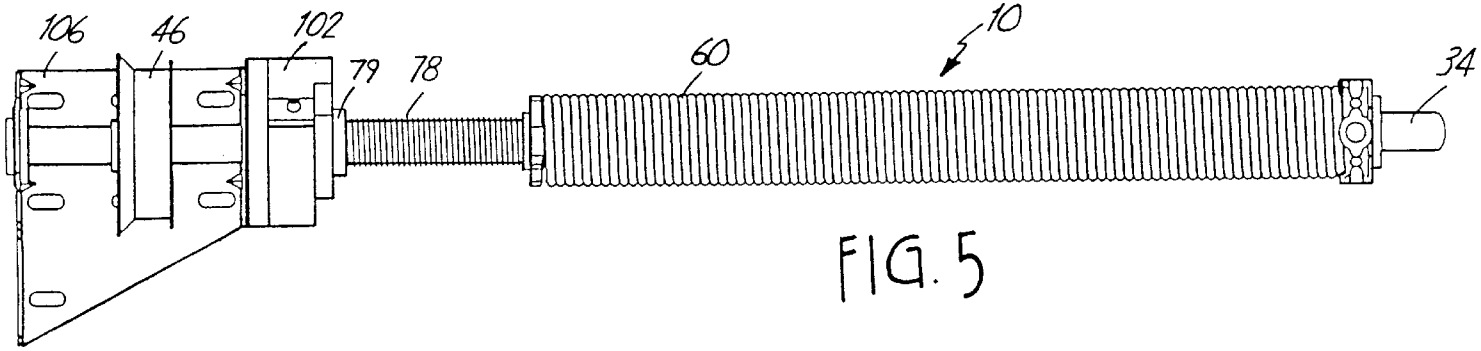
FIG. 5 is a front view of a counterbalancing mechanism of the present invention.
Figure 6:
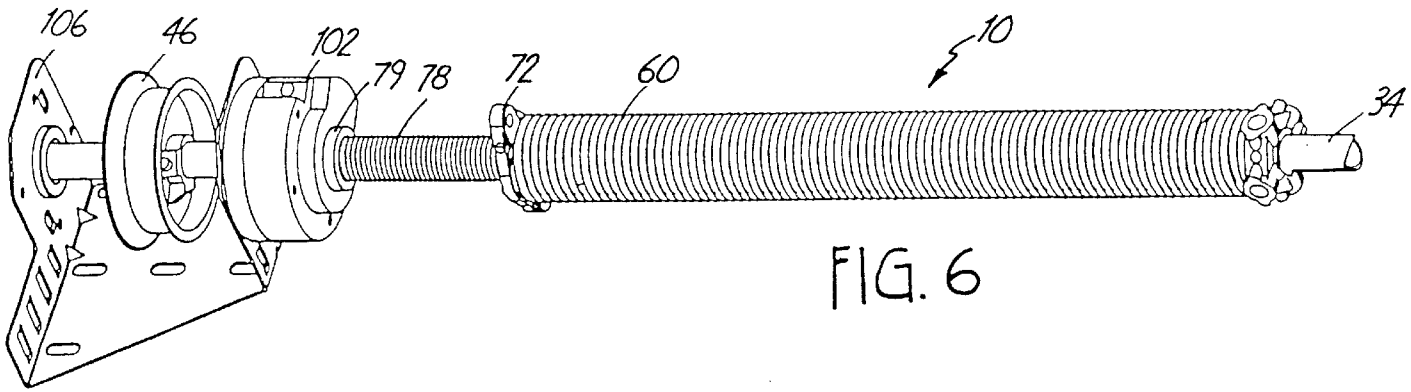
FIG. 6 is a perspective view of a counterbalancing mechanism of the present invention.
Figure 8:
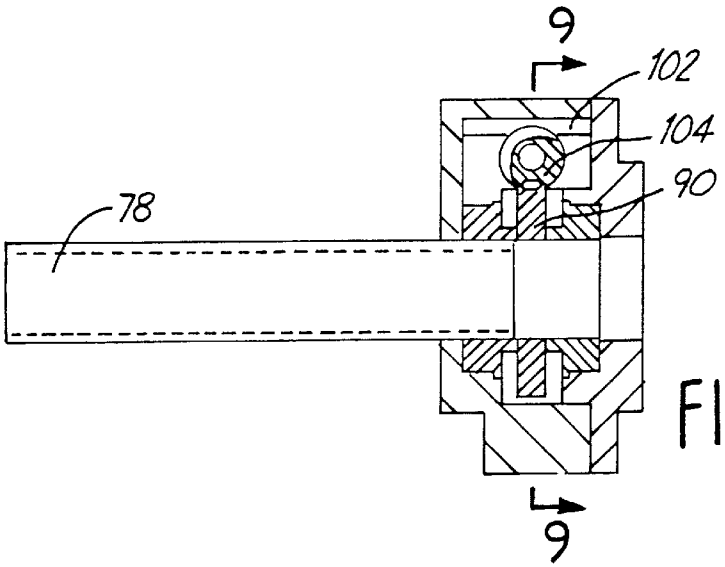
FIG. 8 is an enlarged vertical sectional view of a counterbalancing mechanism of the present invention.
Figure 9:
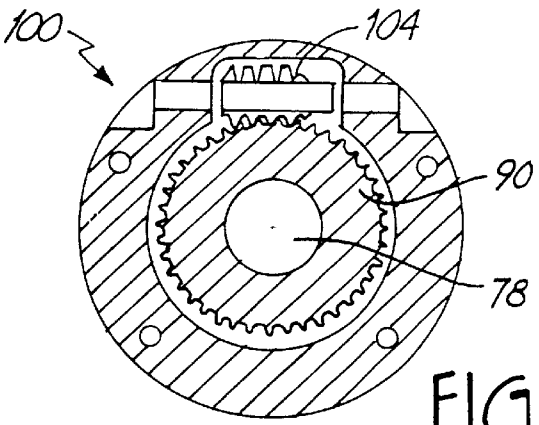
FIG. 9 is an enlarged sectional view as taken along lines 9—9 of FIG. 8.
Figure 7:
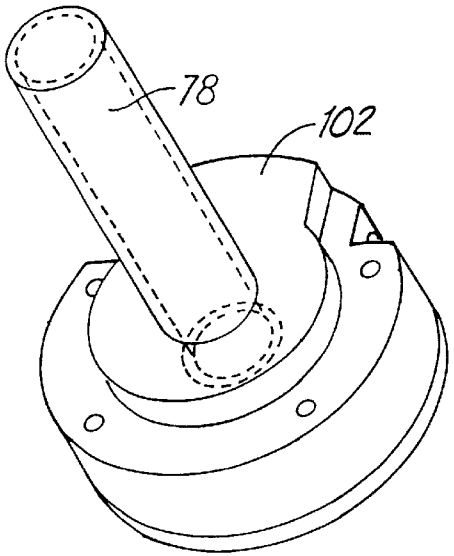
FIG. 7 is a perspective view of a transmission and a torsion shaft of a counterbalancing mechanism of the present invention.

As shown in FIGS. 2, 5, and 6, the first anchor plate 68 is secured to an anchor plate 72 by bolts 74. The anchor plate 72 has a threaded opening 76 which threads onto a threaded shaft 78 concentrically disposed around the torsion shaft 34. The threaded shaft 78 surrounds a portion of the first end 36 of the torsion shaft 34 and features threads 80 which extend over an operative portion of the threaded shaft 78. A gear 90 is positioned concentrically around and secured to the threaded shaft 78. As will be more fully discussed below, the threaded opening 76 of the anchor plate 72 engages the threads 80 of the threaded shaft 78 to elongate the spring 60 and apply torque to the torsion shaft 34.

As shown in FIGS. 4, 7, 8, and 9, the gear 90 interacts with a transmission unit 100 to control the movement of the spring 60 over the threaded shaft 78. The transmission unit 100 features a transmission housing 102 holding a worm gear 104. Opposite ends of the worm gear 104 are rotatably mounted in the transmission housing 102. The transmission housing 102 is designed to fit around the threaded shaft 78 and allows the worm gear 104 to mesh with the toothed gear 90. The worm gear 104 alters the direction of motion, and changes the speed and force. The transmission unit 100 can be a planetary or epicyclic train of gears that do not have back drive. In a preferred embodiment, the transmission unit 100 can operate in two directions that allow for both the winding and unwinding of the spring 60.

The transmission unit 100 is attached to a bracket 106 mounted on structure 21. Bolts 108 secure the transmission housing 102 to the bracket 106 or a similar fixed support.

In use, an electric drill or wrench is used in conjunction with the transmission unit 100 to turn the worm gear 104 to rotate the gear 90 about twenty to forty rotations to stretch and wind up the spring 60. The transmission unit 100 may be driven with a conventional electric motor drill (as shown in 143 in U.S. Pat. No. 3,979,977, which is incorporated herein by reference) to rotate the threaded shaft 78. When the threaded shaft 78 is rotated, the first anchor plate 72 moves along the threaded shaft 78, thereby longitudinally stretching the spring 60 a predetermined distance. A shoulder (first stop 79) disposed along the threaded shaft 78 prevents the movement of the first anchor plate 72 along the threaded shaft 78 beyond a predetermined position so that further rotation of the threaded shaft 78 winds the spring 60 thereby applying a determined counterbalancing torque on the torsion shaft 34.

In the normal unwound resting state of the spring 60, there is no gap between adjacent coils of the spring 60 and the adjacent coils of spring 60 engage each other as shown in FIG. 1. As the anchor plate 72 feeds up the threaded shaft 78 (to the right as seen in FIG. 2), the spring 60 is stretched from its resting state to an extended state and the coils come apart creating gaps (such as gaps 110) between adjacent coils. After stretching the spring, additional turns are put on the spring and the spring 60 increases in length by the diameter of the spring wire for every turn, 360°, of the spring 60. Once the anchor plate 72 abuts the shoulder or first stopn 79 on threaded shaft 78, the spring 60 is wound and the gaps 110 between adjacent coils of the spring 60 close. As the spring 60 is wound, the coils of the spring 60 become closer or touch and the spring coil diameter decreases. When the spring 60 is wound, adjacent coils are in close relationship. The spring 60 is not bound when it is fully wound up. During the winding process of the spring 60, friction forces are generated between adjacent coils of the spring 60. The transmission unit 100 retains the spring 60 in the wound position.

In installations where the roll-up door 20 weighs a significant amount, a pair of counterbalancing mechanisms 10 and 11 may be necessary to support the weight of the roll-up door 20 (FIG. 1). The second counterbalancing mechanism 11 operates in the same manner as the first second counterbalancing mechanism 10. The second counterbalancing mechanism 11 has a second torsion spring 62 located over the torsion shaft 34 and secured to the torsion shaft 34. The free end of the spring 62 interacts with a threaded shaft and a transmission unit 101 winds the spring 62. The counterbalancing mechanisms 10 and 11 have the same structures and operate to apply torsion on the springs 60 and 62, thereby subjecting the torsion shaft 34 to torque the counterbalance of the weight of the roll-up door 20.

When the roll-up door 20 is in its closed position, the springs 60 and 62 are fully energized by the twisting action of torsion shaft 34. The torsion shaft 34 rotates as the roll-up door 20 moves to its closed position, thereby subjecting the springs 60 and 62 to twisting forces which store sufficient energy to counterbalance a substantial portion of the weight of the roll-up door 20. The springs 60 and 62 have sufficient energy so that a small amount of lifting force applied to the roll-up door 20 will open the door. The springs 60 and 62 must be subjected to torsion forces when the door is open so that the springs will hold the door in the open position.

Figure 10:
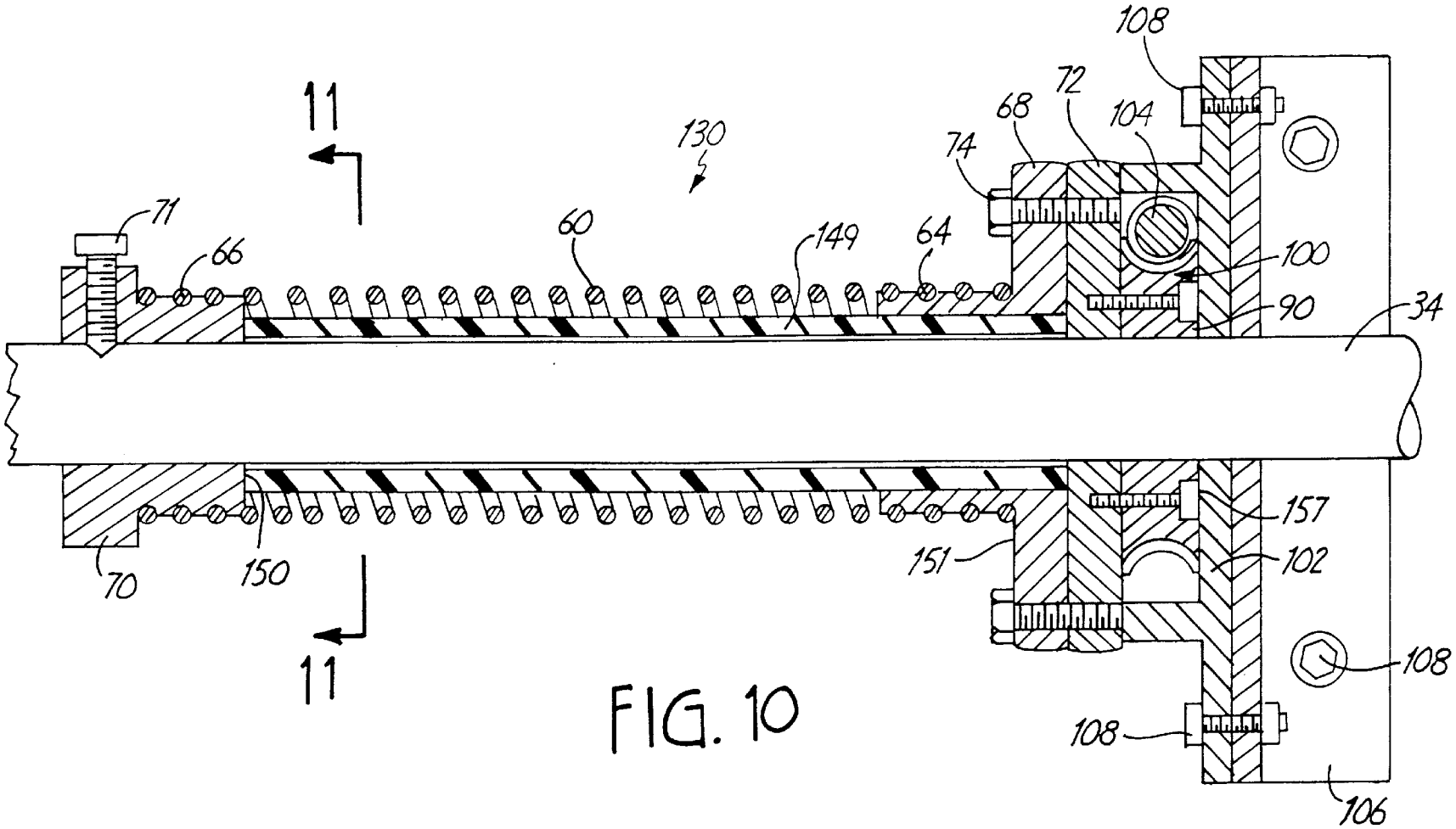
FIG. 10 is an enlarged vertical sectional view of an alternative embodiment of a counterbalancing mechanism of the present invention.
Figure 11:
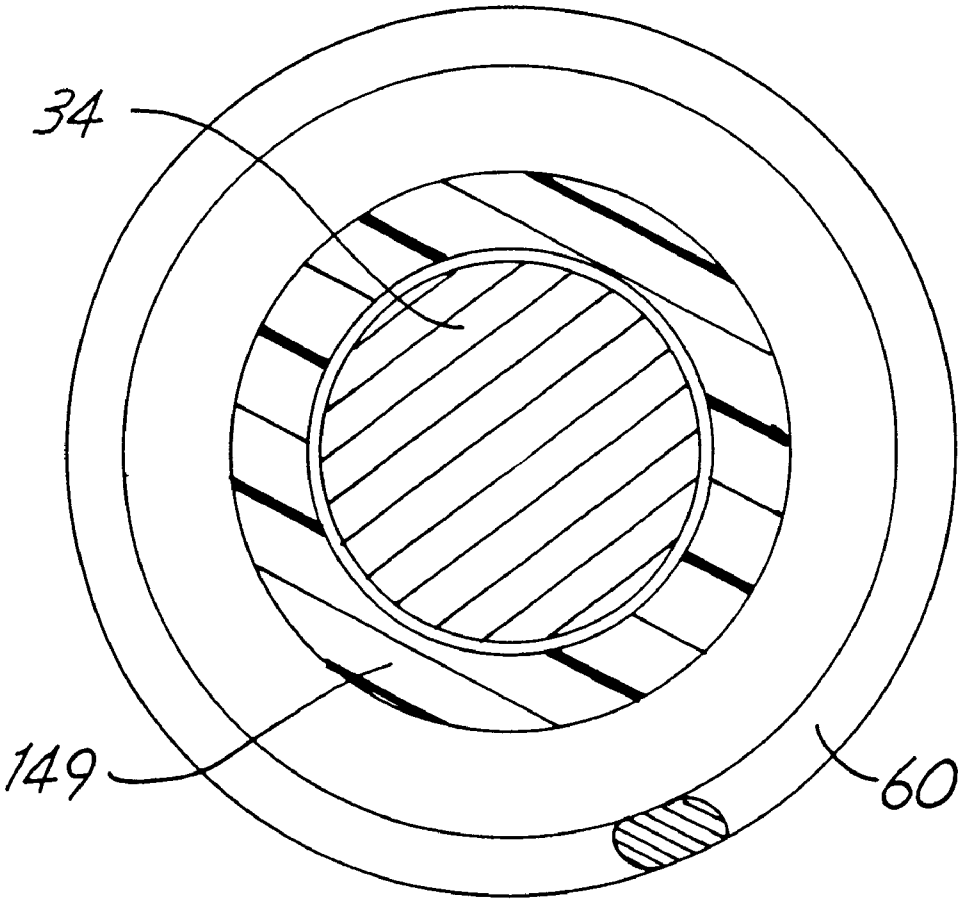
FIG. 11 is an enlarged sectional view as taken along lines 11—11 of FIG. 10.

FIGS. 10 and 11 illustrate an alternative embodiment of the present invention shown generally at 130. The alternative embodiment of the present invention does not utilize the threaded shaft 78. In the alternative embodiment, an elongated tubular member 149 is located within spring 60 and surrounds the torsion shaft 34. The tubular member 149 pre-stretches the spring 60. The tubular member 149 has an end 150 that abuts against the plug 70. An opposite end 151 of the tubular member 149 stretches or longitudinally elongates spring about 2 ½ inches or the length that the spring 60 grows when wound. The spring 60 increases in length by the diameter of spring wire for every turn, 360°, of the spring 60. Adjacent coils of the spring are spaced from each other by the tubular member 149 which pre-stretches the spring. Bolts 157 secure the gear 90 to the plate 72.

The present invention eliminates the dangers of prior art mechanisms relating to torsion spring counterbalancing, simplifies the installation and maintenance with an accompanying savings in time and labor, improves the counterbalancing system installation, and unlike others maintains conventional components known in the art.

Although the present invention has been described with reference to preferred embodiments, workers skilled in the art will recognize that changes may be made in form and detail without departing from the spirit and scope of the invention.

What is claimed is:

1. A counterbalancing apparatus for a roll-up door comprising:

a torsion shaft having first and second ends, each end rotatably held by a support;

a first threaded shaft concentrically disposed around the torsion shaft;

a first spring disposed around the torsion shaft, the first spring having a first end and a second end, the first end being secured to a first anchor plate that is threadably mounted onto the threaded shaft so that as the first threaded shaft is rotated, the first anchor plate moves along the first threaded shaft, thereby longitudinally stretching the first spring a predetermined distance, and the second end of the first spring being fixed relative to the torsion shaft; and a first stop disposed along the torsion shaft preventing the movement of the first anchor plate along the first threaded shaft beyond a predetermined position so that further rotation of the threaded shaft winds the first spring thereby applying a predetermined counterbalancing torque on the torsion shaft.

2. The counterbalancing apparatus of claim 1 comprising:

a second anchor plate holding the second end of the spring, the second anchor plate being secured to the torsion shaft.

3. The counterbalancing apparatus of claim 2 wherein set screws secure the second anchor plate to the torsion shaft.

4. The counterbalancing apparatus of claim 2 further comprising:

a second threaded shaft concentrically disposed around the torsion shaft and connected to a transmission;

a second spring disposed generally concentrically around the torsion shaft, the second spring having a first end fixed relative to the torsion shaft and a second end, the second end being secured to a third anchor plate that is threadably mounted onto the second threaded shaft so that as the second threaded shaft is rotated, the third anchor plate moves along the second threaded shaft, thereby stretching the second spring a predetermined distance; and a second stop disposed along the torsion shaft preventing movement of the threadably mounted third anchor plate along the second threaded shaft beyond a predetermined position so that further rotation of the second threaded shaft winds the second spring relative to the torsion shaft thereby applying a predetermined counterbalancing torque on the torsion shaft.

5. The counterbalancing apparatus of claim 4 further comprising:

a fourth anchor plate holding the second end of the second spring, the fourth anchor plate being secured to the torsion shaft.

6. The counterbalancing apparatus of claim 5 wherein set screws secure the fourth anchor plate to the torsion shaft.

7. The counterbalancing apparatus of claim 1 comprising:

a transmission disposed around the torsion shaft and connected to the first threaded shaft.

8. The counterbalancing apparatus of claim 7 wherein the transmission includes a gear positioned generally concentrically around the torsion shaft and secured to the threaded shaft, and a worm gear that meshes with the gear.

9. The counterbalancing apparatus of claim 8 wherein the worm gear is coupled to a drive head that is adapted to allow a power tool to turn the worm gear.

10. A counterbalancing apparatus for a roll-up door comprising:

a torsion shaft having first and second ends, each end rotatably held by a support;

a first elongated tubular member concentrically disposed around the torsion shaft;

a first spring disposed around the elongated tubular member, the first spring having a first end and a second end, the first end being secured to a first anchor plate that is mounted onto the torsion shaft so that as the first anchor plate is rotated, the first anchor plate winds the spring thereby applying a predetermined counterbalancing torque on the torsion shaft, and the second end of the first spring being fixed relative to the torsion shaft; and a first stop disposed along the torsion shaft preventing movement of the elongated tubular member along the torsion shaft.

11. The counterbalancing apparatus of claim 10 comprising:

a second anchor plate holding the second end of the spring, the second anchor plate being secured to the torsion shalt.

12. The counterbalancing apparatus of claim 11 comprising:

a transmission disposed around the first anchor plate, wherein the transmission includes a worm gear that meshes with a gear, the gear rotates to cause the first anchor plate to rotate relative to the shaft.

13. The counterbalancing apparatus of claim 12 wherein the worm gear is coupled to a drive head that is adapted to allow a power tool to turn the worm gear.

14. The counterbalancing apparatus of claim 11 further comprising:

a second elongated tubular member concentrically disposed around the torsion shaft;

a second spring disposed around the second elongated tubular member, the second spring having a first end and a second end, the first end being secured to a third anchor plate that is mounted onto the torsion shaft so that as the third anchor plate is rotated, the third anchor plate winds the second spring thereby applying a predetermined counterbalancing torque on the torsion shaft, and the second end of the first spring being fixed relative to the torsion shaft; and a second stop disposed along the torsion shaft preventing movement of the elongated tubular member along the torsion shaft.

15. The counterbalancing apparatus of claim 14 further comprising:

a fourth anchor plate holding the second end of the second spring, the fourth anchor plate being secured to the torsion shaft.

* * * * *

UNITED STATES PATENT AND TRADEMARK OFFICE

CERTIFICATE OF CORRECTION

PATENT NO. : 6,327,744 B1
DATED : December 11, 2001
INVENTOR(S) : Edward Dorman

It is certified that error appears in the above-identified patent and that said Letters Patent is hereby corrected as shown below:

Column 5,
Line 54, delete "stopn", insert -- stop --

Column 7,
Line 18, delete "second", insert -- first --

Signed and Sealed this

Second Day of July, 2002

*Attest:*

*Attesting Officer*

JAMES E. ROGAN
*Director of the United States Patent and Trademark Office*